United States Patent [19]

McCann

[11] Patent Number: 4,525,270

[45] Date of Patent: Jun. 25, 1985

[54] MINERAL SEPARATING PROCESS AND APPARATUS

[76] Inventor: John C. McCann, 4034 Agua Dulce Blvd., La Mesa, Calif. 92041

[21] Appl. No.: 483,634

[22] Filed: Apr. 11, 1983

[51] Int. Cl.[3] ..... B07B 9/00

[52] U.S. Cl. ..... 209/44; 209/458; 209/202; 210/474

[58] Field of Search ..... 55/361; 209/13, 14, 209/44, 50, 174, 202, 206, 458, 506; 210/323.2, 210/474, 484

[56] References Cited

U.S. PATENT DOCUMENTS

| | | | |
|---|---|---|---|
| 597,113 | 1/1898 | Greene | 209/50 |
| 1,169,083 | 1/1916 | McLean | 209/14 |
| 1,973,770 | 9/1934 | McCullough | 209/44 |
| 2,294,587 | 9/1942 | Vissac | 209/458 |
| 2,496,757 | 2/1950 | Sieling | 210/474 |
| 2,872,043 | 2/1959 | Fitzgerald et al. | 210/323.2 |
| 3,315,804 | 4/1967 | Brauchla | 209/44 |
| 3,403,781 | 10/1968 | Drago | 209/506 |
| 4,319,985 | 3/1982 | Hibbard | 209/458 X |

*Primary Examiner*—Charles Hart

[57] ABSTRACT

Heavy minerals such as gold, silver, platinum, etc., along with gemstones such as diamonds, rubys, sapphires, etc., occuring in nature in the free state or having been mechanically released by crushing, screening and/or sorting into a free state, can be separated from the common material, into which they are mixed, by applying water to the mixture of materials and allow their different specific gravities to separate them into the bottom of a grooved trough. In the novel mineral concentrator described, to minimize the loss of water, a recirculating pump re-uses the same water from a reservoir repeatedly. The free minerals and gemstones settle out of the main water flow and are trapped into grooves and other pockets and crevices. Some of the pump's water flow is allowed into a feed hopper to wash down the hopper's walls, and in conjunction with shaped apertures in the hopper bottom, automatically regulate the flow of material entering the main trough or sluice. All of the lighter material which leaves the sluice section, passes into a filter bag which retains the particulate matter, thus separating the waste material from the water which is left in a clean condition.

9 Claims, 2 Drawing Figures

MINERAL SEPARATING PROCESS AND APPARATUS

BACKGROUND OF THE INVENTION

This invention relates to a process and apparatus for separating and concentrating heavy minerals such as gold, silver, platinum, etc., and gemstones such as diamonds, rubys, sapphires, etc., occurring in a free state from their associated ores or other common materials. These valuable minerals may be present in small volumes randomly occurring in nature or finely dispersed in concentrates resulting from other mining processes such as dredging, drywashing, sluicing, trommeling, etc., which here-to-fore had little, if any, commercial value because of the large recovery cost in either manpower or equipment time, and hence were abendoned. A particular field in in which this problem of final, fine mineral recovery occurs is in recreational prospecting or mining.

Various types of apparatus have in the past been employed to recover precious metals, minerals, and gemstones from natural or concentrated materials using water techniques. One of the oldest types of equipment used has been the gold or diamond sluice. Heavy particles such as gold, diamonds, etc., sink to the grooved or baffled bottom of an inclined trough or flume filled with flowing water. As the heavier material concentrated from the sluice box or other ore concentrating devices, it still had to be further refined or reduced into a practical amount of final concentrate which would have a high percentage of valuable minerals.

The basic problem with existing devices is that they are not efficient in the final recovery of low grade ore concentrates. This inefficiency takes the form of either high commercial processing costs, high cost of recovery equipment, or excessive and tedious time for recovery, even for the "hobbyiest" who may consider is time as free.

Furthermore, the amount of energy or water required for final recovery is excessive.

Furthermore, expensive mercury amalgamation, followed by the dangerous use of Nitric Acid and the poisonous fumes from mercury retorting, is typically used following the implementation of existing devices in gold recovery.

Consequently, the prior art devices were limited in overall efficiency and/or high cost, thus large amounts of low grade ore concentrates remain unprocessed, have been discarded, and here-to-fore could not be further economically refined with available apparatus.

It is, therefore, the object of this invention to provide a novel process and apparatus which is adapted to efficiently separate small amounts of heavy minerals from both natural occurring concentrates and low grade ore concentrates from other mining apparatus, including the heavy and difficult concentrate made up of iron ores such as hematite, ilmenite, magnetite, etc., commonly known as "black sand".

It is also an object of the invention to provide a small, light-weight portable device.

It is also an object of the invention to provide a device that is economical to manufacture and market.

It is a further object of the invention to provide an efficient means of minimizing the amount of water and energy required to final process or concentrate the ore.

Other objects of this invention will become apparent from the description and two (2) drawings to follow, which show a perspective view of this invention from the front end and a cross-section view of the water and material path.

SUMMARY OF THE INVENTION

According to the invention, the novel process and apparatus is designed to recover valuable, heavy particles from a lighter matrix material using water in a new and novel manner. Water is typically introduced into the sluice and feed hopper sections as to both regulate material flow and to separate out the heavy, valuable particles. A filter catch bag holds all of the lighter processed material, thus separating the waste material from the water and pump. Provisions are made to conveniently mount the novel invention to a base and an inclination angle indicator is included. The described novel mineral concentrator is comprised of a material feed hopper and sluice box section, which can be fabricated from metal or molded plastics such as polycarbonate, ABS, polyethelene, polypropolene, etc. The hopper and sluice being attached to each other to serve new and usefull functions.

Water is introduced at one end, under the feed hopper. A portion of this water is allowed to enter the top of the feed hopper, providing two novel functions: First, the water washes down the hopper walls Second, in conjunction with shpaed aperture(s) in the hopper's bottom. to automatically regulate the flow of ore slurry entering the sluice box section and riffles. The majority of the water is baffled under the hopper and thus enters the sluice section in the required uniform manner. The other end of the sluice section is open to allow the discharge of water and waste material.

Attached to the feed hopper is a gravity actuated inclination indicator. This is required to obtain repeatable results in separating out valuable minerals from the water flow as it passes over the sluice's riffles and baffles. This angle is typically 5° to 15° depending on the characteristics of the ore slurry, size of the valuable mineral being sought, and the flow rate of the water.

All of the lighter waste material, or tailings, that leave the sluice section flow into a filter bag that is suspended from the end of the sluice section by a bail and hook arrangement. The unique function of the filter bag is four fold: First, it filters out visible particulate matter from the water so as to keep it clean, thus allowing the operator to cleary observe the action of the slurry as it passes over the riffles and baffles; Second, the water re-circulating pump is kept free from foreign matter fouling its impeller; Third, all the waste tailings may be reprocessed through the feed hopper to check the efficiency of the first pass of material or to obtain a higher efficiency when working with subvisible valuable particles; Forth, as the filter bag is removed (when full) it can be "squeezed" to remove the entrapped water from the waste tailings. This water can be saved and reused to conserve water. The filter bag is fitted with an open weave section or "window" about $\frac{3}{4}$ of the way up from the bottom. This section acts as a controlled overflow for excess water in the bag (high water level) caused by fine particulate matter which can "plug up" the fine weave of the fabric that comprises the majority of the bag. Under this overflow condition the water clarity will be reduced, but the pump will still be protected.

Attached to the main sluice section are a pair of pivoting mounting struts. They allow the novel mineral concentrator to be mounted over the rim of any bucket, tub, or stuck into the ground next to a body of water. By tightening wing nuts, the mounting struts are clamped against the sluice section body. High friction washers are placed between the struts and the sluice section to prevent rotation or change in angle of the sluice section.

For maximum efficiency, a small 12 watt submersible pump is placed into the water supply. This allows the water to be re-used indefinately, as it is constantly being filtered through the bag. This process is continuous and can be controlled by regulating: The angle of the sluice section or inclination; The amount of water flow; The time between sucessive batches of material being introduced into the feed hopper. In practice, the valuable mineral recovery efficiency varies from 90% to 98% for visible gold (larger than 200 mesh) to from 60% to 80% for sub-visible gold (500 to 200 mesh) on the first pass. The amount of material that can be processed by the novel mineral concentrator varies with the size of the sluice section and the type of ore concentrate. For example, approximately ten pounds per hour, per inch, of sluice width can be processed with visible gold. The efficiency of the final concentration has been demonstrated to be typically 1000 to 1, that is, two (2) gallons of ore concentrate is recuced to about one (1) tablespoon.

DESCRIPTION OF THE PREFERRED EMBODIMENTS

Figures 1, 2:
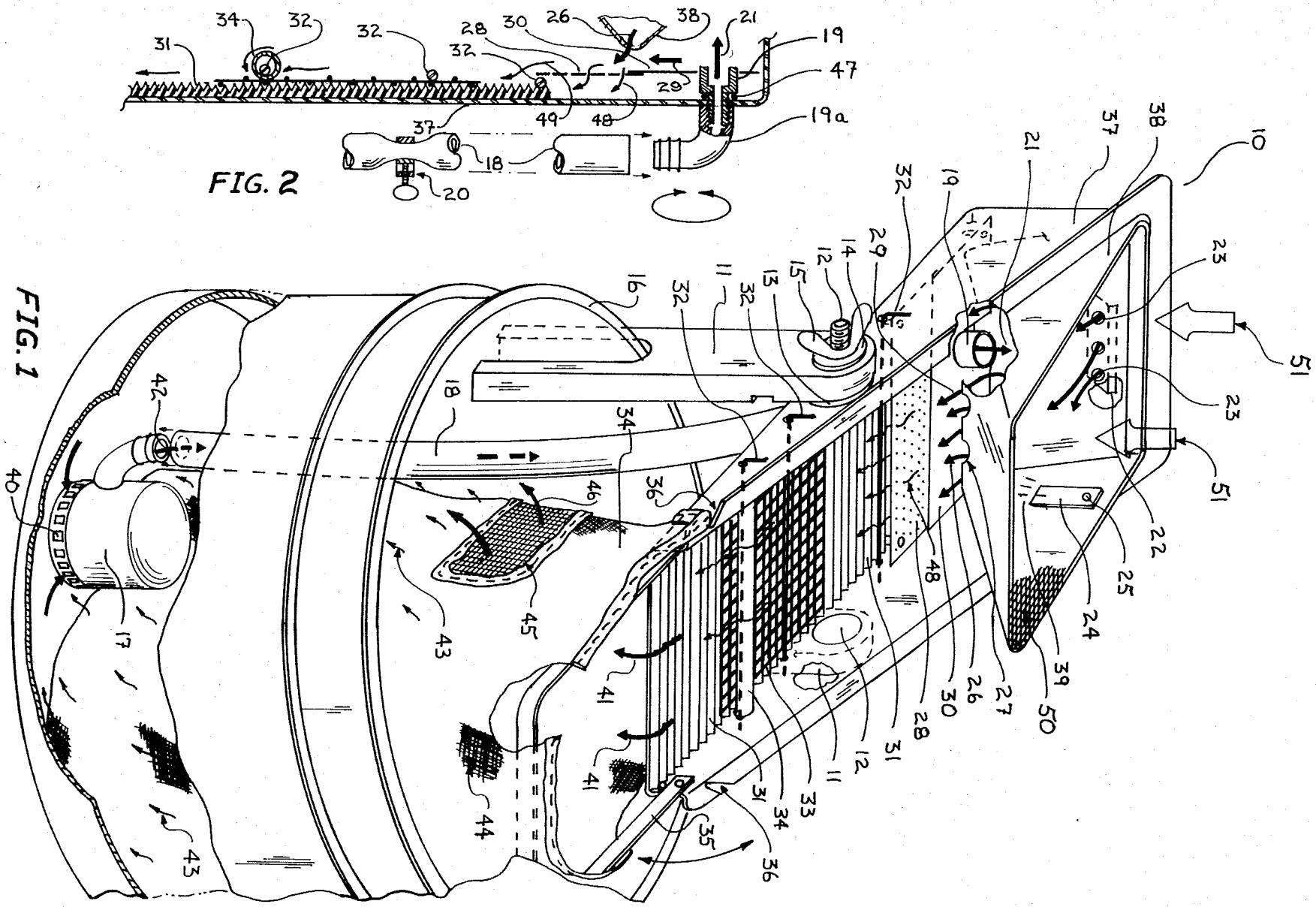
FIG. 1 is a perspective of the novel mineral concentrator.
FIG. 2 is a crossection of the sluice and hopper section showing the water and ore slurry flow paths.

In FIG. 1, the novel mineral concentrator 10 is shown mounted on vertical mounting struts 11. The struts support the sluice and hopper sections 37, 38 in a pivotal manner through the use of mounting studs 12, friction washers 13, back up washers 14, and wing nuts 15. The lower half of the mounting struts are slotted to facilitate mounting over the rim of a bucket 16 or other water container, or to be pressed into the ground. A pump 17 and hose 18 introduce water into the back of the sluice section's bottom via an elbow fitting 19, 19*a* (FIG. 2), and control clamp 20. The water 21 enters an angular cavity created by the vertical sluice section's back and the sloping back of the feed hopper.

Some of this water strikes the inlet baffle 22 and enters through shaped apertures 23 into the feed hopper. The inclination indicator 24 is mounted to the side of the feed hopper and can freely pivot on the pivot boss 25 in response to gravity. Water and slurry 26 flow out of the bottom of the feed hopper through shaped apertures 27. The mixture flows onto the perforated plate 28 and mixes with the majority of the water flowing horizontally 29 over the deflector plate 30 and perforated plate 28. Fine material 48 (FIG. 2) can drop through the plurality of small holes in the perforated plate and into slower moving water so as to not to be carried away by the faster moving water 49 (FIG. 2). The remainder of the slurry then flows onto the riffle mat 31, retainer rods 32, mesh trap 33, and shapped riffle 34. Heavy minerals are trapped in the plurality of vee grooves in the riffle mat 31, or in other crevices and hydraulic eddys caused by the retainer rods, mesh trap, and shapped riffle(s). The lighter material 41 works its way down the water-washed, inclined sluice bottom and into the filter bag 34. The bag is supported by a folding support bail 35 and retaining hooks 36 in the flanges of the sluice section.

In operation, typically mounted to a $5\frac{1}{2}$ gallon commercial bucket, the submursible pump 17 recirculates 42 and filters 43 the water about 100 times per hour through the sluice and hopper sections 37, 38 and filter bag 34. With an external water source, the novel mineral concentrator 10 requires only about one gallon per minute, per inch, of sluice width at a hydraulic pressure head of ten feet. Water input from any dirtction can be accomidated by rotating the inlet elbow 19, 19*a* and seal 47 (FIG. 2) through 360° of rotation.

The novel mineral concentrator 10 set up is accomplished by sliding the slotted mounting struts 11 over the edge of a container of water or pressing the struts into the ground next to a body of water. The wing nuts 15 are tightened securly as to acheve the proper angle of inclination as shown by the indicator 24 and reference marks 39. The opening of the filter bag 34 is placed over the bag bail 35 and the open edge is brought under the end of the sluice section 37 and up through the slotted bag retainer hooks 36 taughtly. The size of the filter bag opening now prevents the bag from slipping off the far end of the bag bail 35. The pump 17 with its hose 18 is now inserted into the water and the free end of the hose is slipped over the end of the inlet fitting 19*a*. Water is added to the bucket in any amount so long as the pump inlet 40 is covered, typically a minum of two or three inches. The pump or other water source is now activated, the flow rate being controlled by the design of the apertures 23 and a valve or clamp 20 (FIG. 2). Material 51 that has been presorted (typically through an eight mesh screen, which may be fitted to the top of the hopper 38), is introduced into the feed hopper 38 as to fill it $\frac{1}{4}$ to $\frac{1}{2}$ full. A portion of the water strikes the inlet baffle 22 and passes through shaped apertures 23 and into the feed hopper. The wetted material forms a slurry and passes through the shaped apertures 27 in the bottom of the hopper which regulates the flow of slurry entering the sluice section 37. A unique feature of the hopper feed system is that it automatically regulates material (slurry) without regards to its moisture content.

The water and slurry now flow across the various elements of the sluice section as previously described and into the filter bag where the particulate matter is separated from the water. As the fine matter "plugs up" the tight bag weave 44 the water level in the bag rises until the coarse weave 45 is reached, allowing a controlled over flow of water 46. Since the water is clean, visual inspection of the various riffles and traps 32, 33, 34, and 31 can be made at any time during operation to check efficiency. If any gold or other valuable mineral is observed trapped too close to end of the sluice (within one or two inches), the operation can be altered to preclude lost values by reducing the angle of inclination of the sluice and hopper sections 37, 38.

Approximately once every hour of operation, or when sufficient amounts of a valuable mineral are visible, the clean up process is accomplished. The removal of the perforated plate 28 and deflector plate 30, mesh trap 33, riffle mat 31, and shaped riffle 34 is uniquely accomplished by pulling out the retaining rods 32, thus allowing accumulated values to be easly washed, with out obstruction, into a small container for collection.

What is claimed is:

1. Mineral separating apparatus comprising:

an elongated sluice box having a bottom wall, a pair of laterally spaced side walls and a rear wall;

a feed hopper having a front wall, a sloping rear wall, and laterally spaced side walls, said front wall and said rear wall being connected together at their bottom ends and having a plurality of primary apertures laterally spaced along the bottom edge where they meet;

said feed hopper being mounted in said sluice box with the top edge of the rear wall of said feed hopper being adjacent the rear wall of said sluice box whereby the rear wall of said sluice box and the rear wall of the feed hopper form an angular cavity;

the bottom edge of said feed hopper being spaced upwardly a predetermined distance from the bottom wall of said sluice box so that a predetermined volume of water can flow through said angular cavity in a predetermined period of time;

the rear wall of said feed hopper having at least one secondary aperture therein adjacent its top edge, an inlet baffle mounted along the back surface of the rear wall of said feed hopper at a position behind said secondary aperture for the purpose of deflecting water directed upwardly against said inlet baffle through said secondary aperture into the interior of said feed hopper;

a water inlet aperture formed in the bottom wall of said sluice box at a position beneath the inlet baffled of said feed hopper whereby water under pressure directed through said water inlet aperture will hit said inlet baffle thereby directing part of it forwardly through said secondary aperture into the interior of said feed hopper; and means positioned along the top surface of the bottom wall of said sluice box for trapping heavy mineral particles that have been separated from a slurry mixture.

2. Mineral separating apparatus as recited in claim 1 further comprising a container for holding a predetermined amount of water and means for detachably mounting said sluice box on said container.

3. Mineral separating apparatus as recited in claim 1 further comprising a pair of laterally spaced elongated mounting struts having one of their ends pivotally attached to the respective opposite side walls of said sluice box.

4. Mineral separating apparatus as recited in claim 1 further comprising gravity activated means for measuring the inclination of the bottom wall of said sluice box.

5. Mineral separating apparatus as recited in claim 1 further comprising an elbow-shaped water inlet fitting rotatably mounted in the water inlet aperture of said sluice box.

6. Mineral separating apparatus as recited in claim 2 further comprising a filter bag detachably mounted on one end of said sluice box.

7. Mineral separating apparatus as recited in claim 2 further comprising a predetermined length of hose and a water recirulating pump, one end of said hose being connected to said water inlet aperture in the bottom wall of said sluice box and its other end being connected to said water recirculating pump.

8. Mineral separating apparatus as recited in claim 1 wherein the height of the side walls of said sluice box taper downwardly from the rear of the sluice box to the front of said sluice box.

9. Mineral separating apparatus comprising:

an elongated sluice box having a bottom wall, a pair of laterally spaced side walls and a rear wall;

a feed hopper having a front wall, a sloping rear wall, and laterally spaced side walls, said front wall and said rear wall being connected together at their bottom ends and having a plurality of primary apertures laterally spaced along the bottom edge where they meet;

said feed hopper being mounted in said sluice box with the top edge of the rear wall of said feed hopper being adjacent the rear wall of said sluice box whereby the rear wall of said sluice box and the rear wall of the feed hopper form an angular cavity;

the bottom edge of said feed hopper being spaced upwardly a predetermined distance from the bottom wall of said sluice box so that a predetermined volume of water can flow through said angular cavity in a predetermined period of time;

the rear wall of said feed hopper having at least one secondary aperture therein adjacent its top edge;

means for introducing a predetermined flow of water into the area of the sluice box between the rear wall of said sluice box and the rear wall of said feed hopper;

means for deflecting a portion of said predetermined flow of water that is being introduced into said sluice box so that the water is directed through said secondary aperture into the interior of said feed hopper while the major portion of said predetermined flow of water will flow down said sluice box beneath the bottom edge of said feed hopper; and means positioned along the top surface of the bottom wall of said sluice box for trapping heavy mineral particles that have been separated from a slurry mixture.

* * * * *